US006035732A

United States Patent [19]

Ogishima et al.

[11] Patent Number: 6,035,732

[45] Date of Patent: Mar. 14, 2000

[54] STARTER HAVING A VENTILATION PASSAGE

[75] Inventors: Kenji Ogishima, Nagoya; Masanori Ohmi, Anjou; Yoshito Takagi, Toyohashi, all of Japan

[73] Assignee: Denso Corporation, Kariya, Japan

[21] Appl. No.: 09/140,416

[22] Filed: Aug. 26, 1998

Related U.S. Application Data

[62] Division of application No. 08/812,883, Mar. 6, 1997, Pat. No. 5,875,677.

[30] Foreign Application Priority Data

| | | | |
|---|---|---|---|
| Mar. 8, 1996 | [JP] | Japan | 8-51747 |
| Mar. 25, 1996 | [JP] | Japan | 8-67670 |
| Nov. 26, 1996 | [JP] | Japan | 8-314325 |

[51] Int. Cl.[7] ..... F02N 15/00; F02N 15/06

[52] U.S. Cl. ..... 74/6; 74/7 R; 74/7 A; 310/60 A

[58] Field of Search ..... 74/6, 7 R, 8, 7 A, 74/7 E; 310/58, 59, 60 A

[56] References Cited

U.S. PATENT DOCUMENTS

| | | | |
|---|---|---|---|
| 4,547,687 | 10/1985 | Arai | 310/58 |
| 5,101,114 | 3/1992 | Isozumi et al. | 74/7 A |
| 5,307,700 | 5/1994 | Spellman et al. | 74/7 A |
| 5,443,553 | 8/1995 | Shiga et al. | 74/7 |
| 5,698,914 | 12/1997 | Shiga et al. | 310/60 A |

FOREIGN PATENT DOCUMENTS

| | | |
|---|---|---|
| 58-134062 | 9/1983 | Japan . |
| 63-253170 | 10/1988 | Japan . |

*Primary Examiner*—David A. Bucci
*Assistant Examiner*—William C Joyce
*Attorney, Agent, or Firm*—Pillsbury Madison & Sutro LLP

[57] ABSTRACT

A starter for an engine includes a housing. A starter motor in said housing includes a field apparatus including a tubular yoke being provided to form a part of the housing. An annular ventilation passage is provided in the starter defined along an inner periphery of the yoke and being hermetically sealed from an inside of the yoke. A first ventilation hole is defined proximate a bottom portion of the housing for interconnecting an inside of the passage to an outside of the housing. A second ventilation hole is defined proximate a top portion of the ventilation passage for interconnecting the inside of the passage to an inside of the starter motor.

11 Claims, 11 Drawing Sheets

STARTER HAVING A VENTILATION PASSAGE

This is a division of application Ser. No. 08/812,883, filed Mar. 6, 1997 issued as U.S. Pat. No. 5,875,677, Mar. 2, 1999.

CROSS REFERENCE TO RELATED APPLICATIONS

This application is based upon and claims priority from Japanese Patent Application Nos. Hei 8-51747, filed Mar. 8, 1996, Hei 8-67670, filed Mar. 25, 1996, and Hei 8-314325 filed Nov. 26, 1996, the entire contents of which are incorporated herein by this reference.

BACKGROUND OF THE INVENTION

1. Field of the Invention

The present invention relates to a starter for starting an engine.

2. Description of Related Art

One type of known starter used for starting engines has an opening in its housing. With such a starter, water may enter into the housing through the opening because the rotating ring gear carries water from a bottom of a transmission case or the like. If the transmission case has a hole facing the ground in order to drain water out from inside of the case, this is more likely to happen. Such water in the housing may cause corrosion of the inside of the starter.

JP-A-63-253170 discloses a starter having a water barrier structure which prevents water from entering the starter through an opening in its housing. According to the water barrier structure, the opening of the housing is opened and closed by a rotatably supported cover. The opening in the housing is closed when the starter is not under operation. The opening is opened by pushing a recess or a protrusion, which has a screw shape, provided at the cover with an arm portion of a drive lever when the starter is under operation.

However, according to the starter disclosed in JP-A-63-253170, water carried by a rotating ring gear can not be prevented from entering the housing when the starter is under operation because the opening in the housing is opened while the starter is under operation.

SUMMARY OF THE INVENTION

The present invention is made in light of the foregoing problem, and it is an object of the present invention to provide a starter which can prevent water from entering into its housing through an opening therein regardless of whether the starter is under operation or not.

It is another object of the present invention to provide a starter which can prevent water from entering the main part of the starter without increasing the size of the starter.

According to the starter of the present invention, the starter for an engine having a ring gear includes an output shaft for slidably holding a pinion gear engageable with the ring gear, a housing having an opening portion that enables the pinion gear to engage with the ring gear when the pinion gear advances, and a cover having a shutter, a front wall and a side wall for sliding together with the pinion gear. The shutter opens the opening portion when the pinion gear advances and shuts most of the opening portion when the pinion gear retracts. The front wall is provided to cover at least half of a front portion, which faces to the ring gear, of the pinion gear. The side wall extends from the front wall in a direction away from the ring gear, to cover at least half of the gear tooth periphery in a circumferential (radial) direction of the pinion gear.

According to the starter constructed as described above, if water carried by the rotating ring gear comes to the opening portion when the pinion gear rotates with the ring gear, most of such water is blocked by the gear teeth. Furthermore, the rest of water is blocked by small gaps between the pinion gear and the cover. While the pinion gear is disengaged from the ring gear, the shutter closes most of the opening portion. Therefore, most of the water carried by the rotating gear is blocked by the shutter. Even if water enters the housing through a small gap between the opening portion and the shutter, water is blocked by small gaps between the pinion gear and the cover.

According to another aspect of the present invention, a starter for an engine includes a housing, a starter motor provided in the housing and having a field apparatus including a tubular yoke in the starter motor, an annular ventilation passage provided along an inner periphery of the yoke, a first ventilation hole provided at approximate the bottom portion of the housing for interconnecting an inside of the ventilation passage to the outside of the housing, and a second ventilation hole provided at approximate the top portion of the ventilation passage for interconnecting the inside of the ventilation passage to an inside of the starter motor.

According to the starter constructed as described above, if water comes to the vicinity of the first ventilation hole, some of such water may enter the ventilation passage through the first ventilation hole. However, water which enters the ventilation passage through the first ventilation hole cannot reach the second ventilation hole against the force of gravity because such water collides with the inside of the annular ventilation passage. Therefore, water can be prevented from entering the starter motor through the second ventilation hole.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Figure 1:
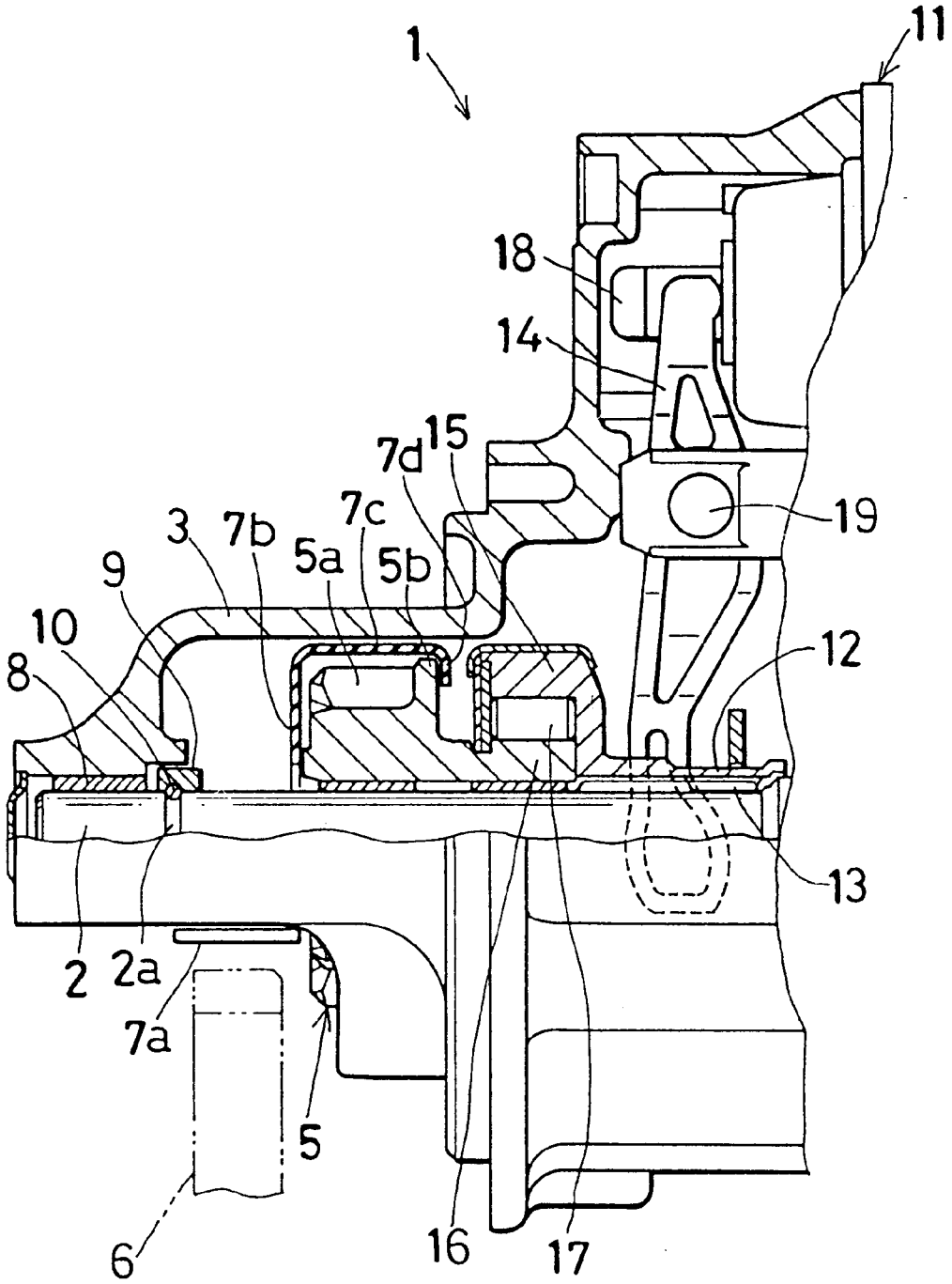
FIG. 1 is a part-sectional view of a portion of a starter that is not in operation, according to a first embodiment of the present invention.

Embodiments of the present invention will be described hereinafter with reference to the drawings.

First Embodiment

A first embodiment of the present invention is shown in FIG. 1 through FIG. 5.

Output shaft 2 is rotatably supported by housing 3 via housing bearing 8 at one end thereof and is rotated by a rotational force of a starter motor (not shown) via a speed reduction apparatus (not shown). Restriction collar 9 which restricts the advance of a pinion (described hereinafter) is attached to the outer periphery of the top portion of output shaft 2. Restriction collar 9 is restricted from advancing along output shaft 2 (to the left in FIG. 1) by snap ring 10 which fits in concave groove 2*a* formed on the outer periphery of output shaft 2. The starter motor is a direct-current motor. Electricity is supplied to the starter motor from a car battery (not shown) when a motor contact (not shown) provided in magnetic switch 11 is on, by turning a starter switch (not shown) on.

The pinion includes sleeve 12, a one-way clutch (described hereinafter) and pinion gear 5 and is slidablly provided on output shaft 2 between a disengaged position (shown in FIG. 1) and an engaged position (shown in FIG. 2) of pinion gear 5 and ring gear 6 of the engine.

Sleeve 12 is fitted to the outer periphery of output shaft 2 via helical spline 13 and is connected to magnetic switch 11 via shift lever 14.

The one-way clutch includes outer member 15 formed with sleeve 12, inner member 16 formed with pinion gear 5, roller 17 locating in a wedge-shaped cam space formed in an inner periphery of outer member 15, and a spring (not shown) which biases roller 17 toward the narrow portion of the cam space.

Pinion gear 5 transmits the rotational force of the starter motor to ring gear 6 by advancing along output shaft 2 and engaging ring gear 6. Pinion gear 5 has gear teeth 5*a* and flange 5*b*. Gear teeth 5*a* engage ring gear 6. Flange 5*b* has a diameter which is approximately the same as or slightly larger than that of a gear tooth 5*a*.

Magnetic switch 11 generates a magnetic field when a coil (not shown) in mgnetic switch 11 is electrified, and sucks a plunger (not shown) provided at an inner periphery of the coil and turns the motor contact on. Such suction power of the plunger drives shift lever 14.

Shift lever 14 is pivotably provided with a fulcrum 19 provided on housing 3. One end of shift lever 14 is connected to joint 18 which is connected to the plunger, and the other end of shift lever 14 is connected to outer periphery of sleeve 12.

Figure 3:
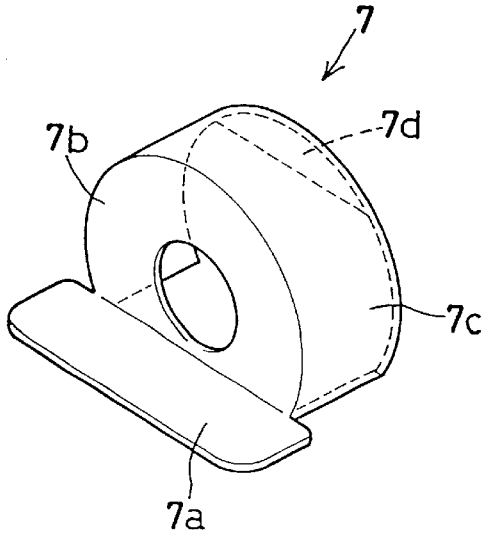
FIG. 3 is a perspective view of a cover according to the first embodiment of the present invention.

As shown in FIG. 3, cover 7 has shutter portion 7*a*, front wall 7*b*, side wall 7*c* and rear wall 7*d*. Side wall 7*c* covers more than one-half of pinion gear 5 in the circumferential direction, at the side diametrically opposite to opening 4. The gap between flange 5*b* and side wall 7*c* is set to be as small as possible. The gap beween pinion gear 5 and front wall 7*b* is also set to be as small as possible.

Figure 4:
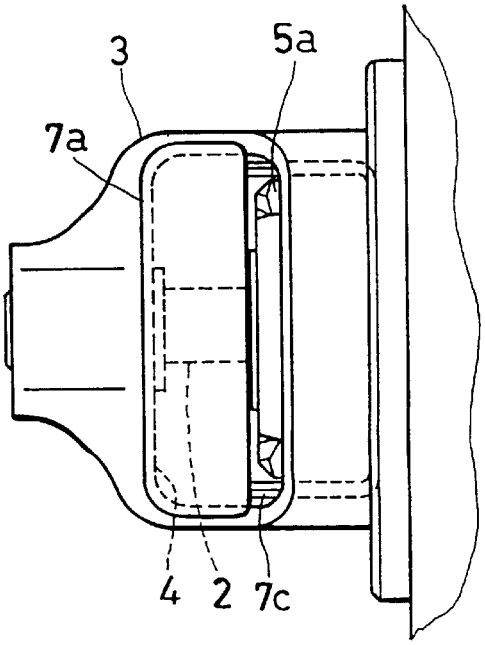
FIG. 4 is a plan view showing an approximate closing state of an opening, according to the first embodiment of the present invention.

Shutter portion 7*a* opens opening portion 4 when pinion gear 5 engages ring gear 6 (FIG. 5), and approximately shuts opening portion 4 when pinion gear 5 is disengaged from ring gear 6 (FIG. 4).

Cover 7 slides with the pinion when the pinion moves toward (engages with) ring gear 6 because the front portion of pinion gear 5 pushes front wall 7*b*. On the other hand, cover 7 slides back to the disengaged position with the pinion when the pinion disengages from ring gear 6 because the rear portion of pinion gear 5 pushes rear wall 7*d*. Shutter portion 7 slides without rotating with pinion gear 5 because shutter portion 7*a* contact housing 3 around opening portion 4 and its rotation is restricted.

When the starter switch is turned on, magnetic switch 11 is activated, the pinion is pushed via shift lever 14 toward ring gear 6 (to the left in FIG. 2) along helical spline 13 on output shaft 2 (FIG. 2), and the motor contact in magnetic switch is on. Then, electricity is supplied to the starter motor from the battery, and an armature (not shown) generates a rotational force. The rotational force is reduced by the speed reduction apparatus and is transmitted to output shaft 2. The rotational force on output shaft 2 is transmitted to pinion gear 5 via the one-way clutch, pinion gear 5 engages ring gear 6, and ring gear 6 rotates to start the engine.

Figure 2:
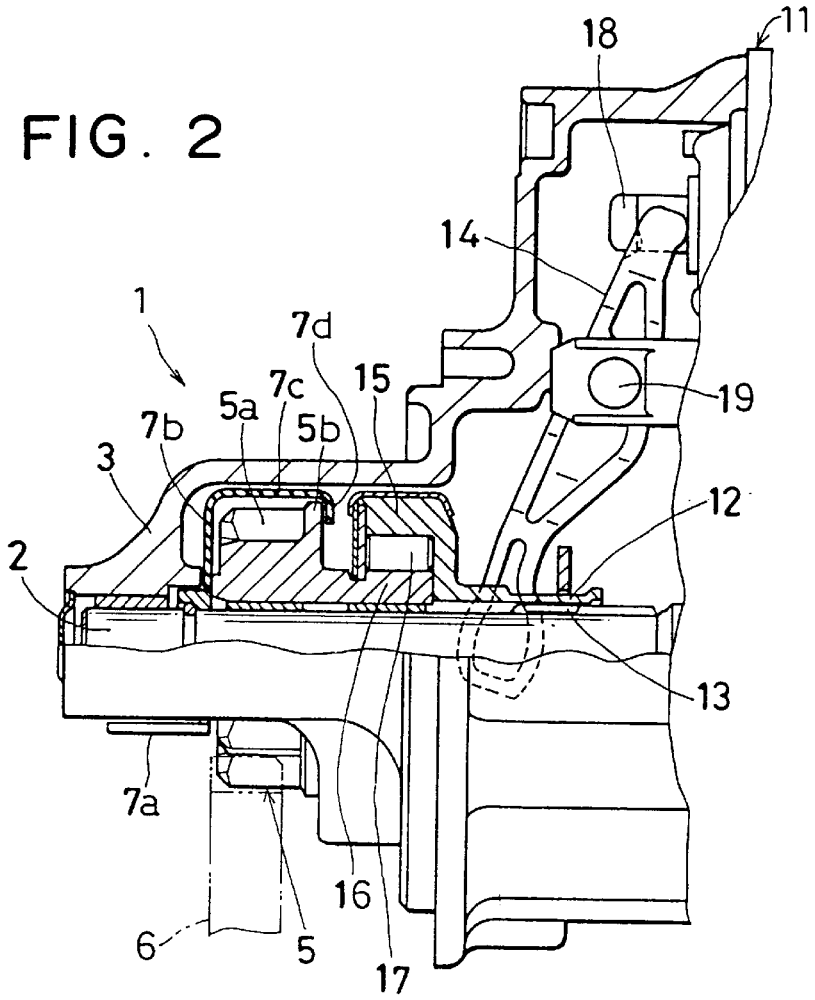
FIG. 2 is a part-sectional view of a portion of starter that is in operation (a pinion gear is engaged with a ring gear), according to the first embodiment of the present invention.
Figure 5:
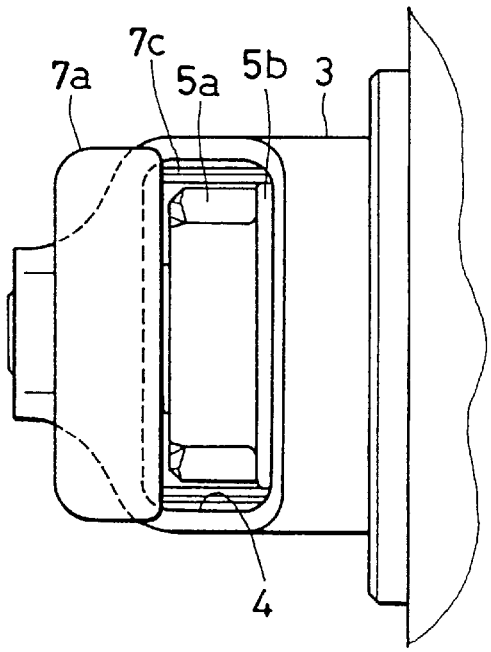
FIG. 5 is a plan view showing an opening state of an opening, according to the first embodiment of the present invention.

While pinion gear 5 is rotating with ring gear 6 as shown in FIG. 2, opening portion 4 of housing 3 is open (FIG. 5). Therefore, water carried by the rotating ring gear 6 comes to opening portion 4. However, most of such water is blocked by gear teeth 5*a*. Furthermore, the rest of the water is blocked by the small gaps between pinion gear 5 and front wall 7*b* and between flange 5*b* and side wall 7*c*. Therefore, there is little possibility for water to enter the starter 1.

After starting the engine, magnetic switch 11 stops when the starter switch is off. Then the rotation of the armature stops because the plunger returns to the initial position, the motor contact is disconnected and the supply of the electricity to the starter motor is stopped. The returning plunger returns the pinion to the disengaged position by moving the top of shift lever 14 to the left in FIG. 1. Therefore, pinion gear 5 disengages from ring gear 6, slides back on output shaft 2 and returns to the disengaged position (FIG. 1).

While pinion gear 5 is in the disengaged position, shutter portion 7*a* closes most of opening portion 4. Therefore, most of the water carried by the rotating gear 6 is blocked by shutter portion 7*a*. Even if water enters housing 3 through a small gap between opening portion 4 and shutter portion 7*a*, water is blocked by the small gaps between pinion gear 5 and front wall 7*b* and between flange 5*b* and side wall 7*c*.

In the first embodiment, flange 5*b*, which is provided at the rear end of pinion gear 5, has an outer diameter slightly larger than that of gear teeth 5*a*. However, a similar result may be obtained even if the outer diameter of flange 5*b* is the same as that of the gear teeth 5*a*.

In the first embodiment, rear wall 7*d* covers only a top portion of pinion gear 5. However, if rear wall 7*d* covers more than one-half of pinion gear 5 at the side opposite opening 4, the water-proof characteristic may be improved.

In the first embodiment, pinion gear 5 has flange 5*b*, like a pinion gear manufactured by cold forging, whose outer diameter is approximately the same as that of pinion gear 5. It is possible to use other pinion gears which do not have such a flange, like a pinion gear manufactured with a hob cutter, but in that case rear wall 7*d* should preferably be extended at least to the bottom of the gear teeth of pinion gear 5, toward the center of pinion gear 5 (like rear wall 127*d* in FIG. 9).

Second Embodiment

Figure 6:
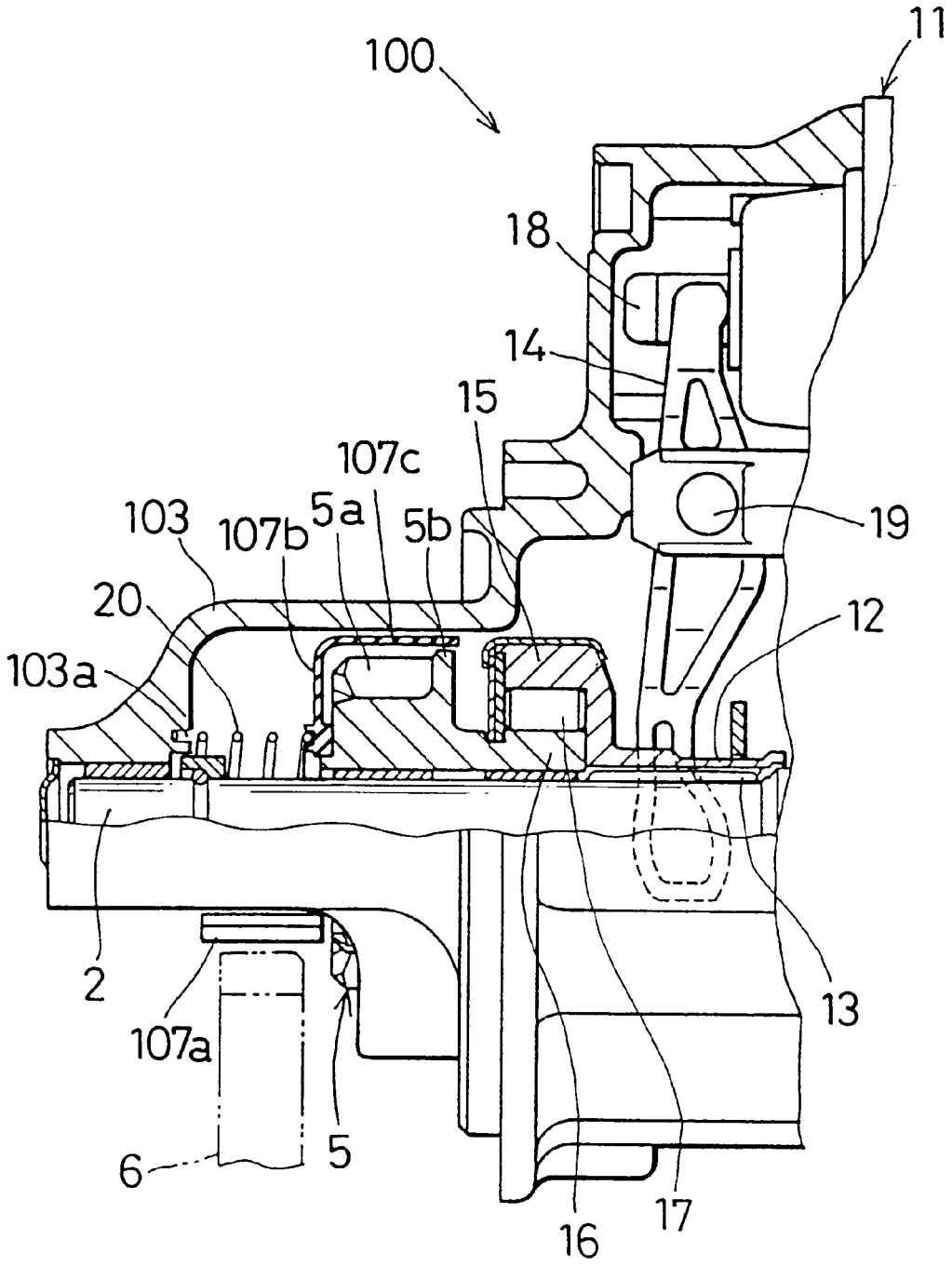
FIG. 6 is a part-sectional view of a portion of a starter that is not in operation, according to a second embodiment of the present invention.
Figure 7:
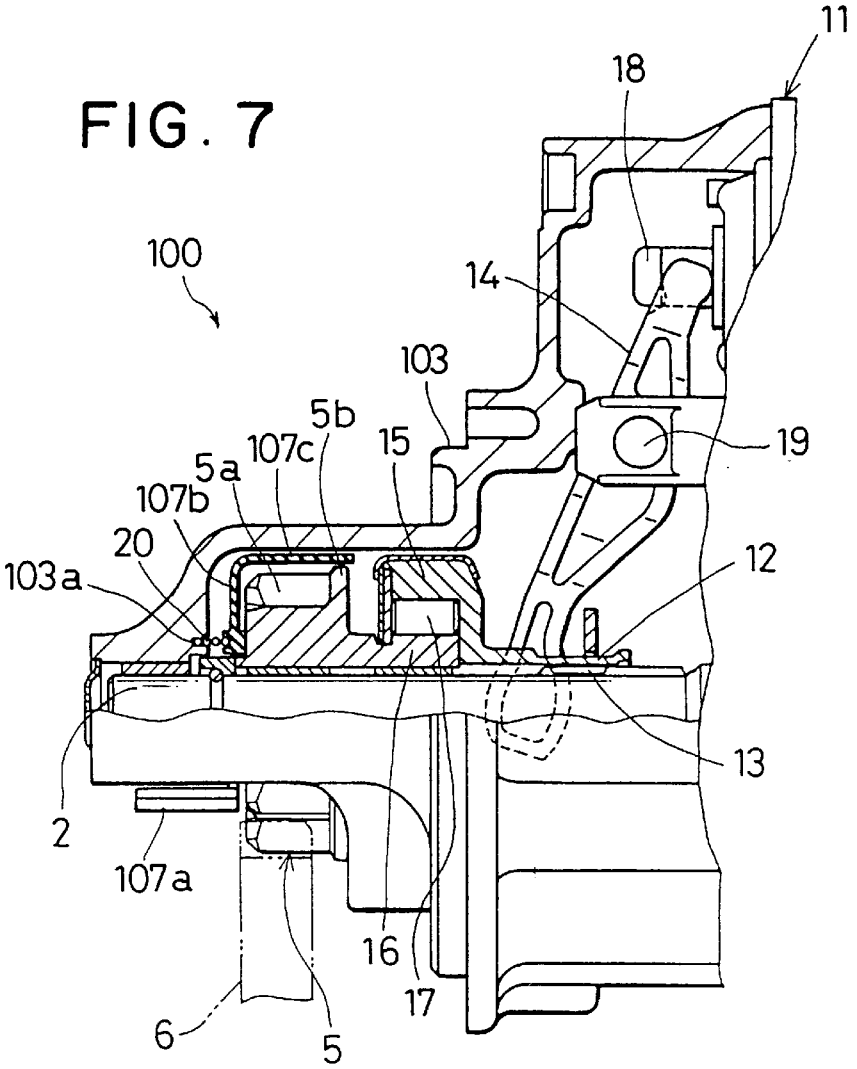
FIG. 7 is a part-sectional view of a portion of a starter that is in operation, according to the second embodiment of the present invention.
Figure 8:
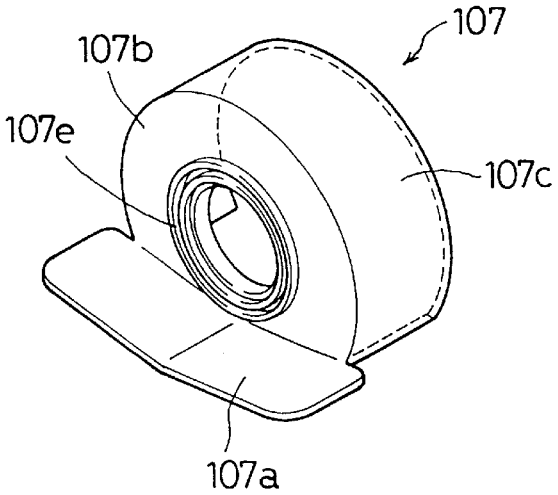
FIG. 8 is a perspective view of a cover according to the second embodiment of the present invention.

A second embodiment of the present invention is shown in FIGS. 6 through 8. FIG. 6 is a part-sectional view of a portion of a starter that is not in operation (pinion gear 5 is disengaged from ring gear 6) and FIG. 7 is a part-sectional view of a portion of a starter that is in operation (pinion gear 5 is engaged with ring gear 6). In this and the third through fifth embodiments, components which are substantially the same to each other are assigned the same or similar reference numerals.

In the second embodiment, spring 20 is placed between housing 103 and front wall 107*b* of cover 107. The pinion and cover 107 are constantly biased toward the rear of output shaft 2 by spring 20. The pinion is returned to the disengaged position (FIG. 6) from the engaged position (FIG. 7) together with cover 107 by spring 20.

One end of spring 20 is fixed in a ring-shaped groove 103*a* formed in housing 103, and the other end is fixed in a ring-shaped groove 107*e*.

Rear wall 7*d* shown in the first embodiment is omitted in the second embodiment because cover 107 is returned to the disengaged position by spring 20.

According to the second embodiment of the present invention, in addition to the same effects and advantages as in the first embodiment, the return force which returns the pinion by magnetic switch 11 can be omitted. Such return force is usually obtained by a return spring which returns the plunger to the initial position when the supply of electricity to the coil is stopped. Therefore, the return spring can be omitted and magnetic switch 11 can be downsized.

It is possible, in the alternative, to use both spring 20 and the return spring of magnetic switch 11. In that case, it may be possible to set the strength of spring 20 so that spring 20 returns only cover 107 and the pinion is returned by the return spring of magnetic switch 11.

Third Embodiment

Figure 9:
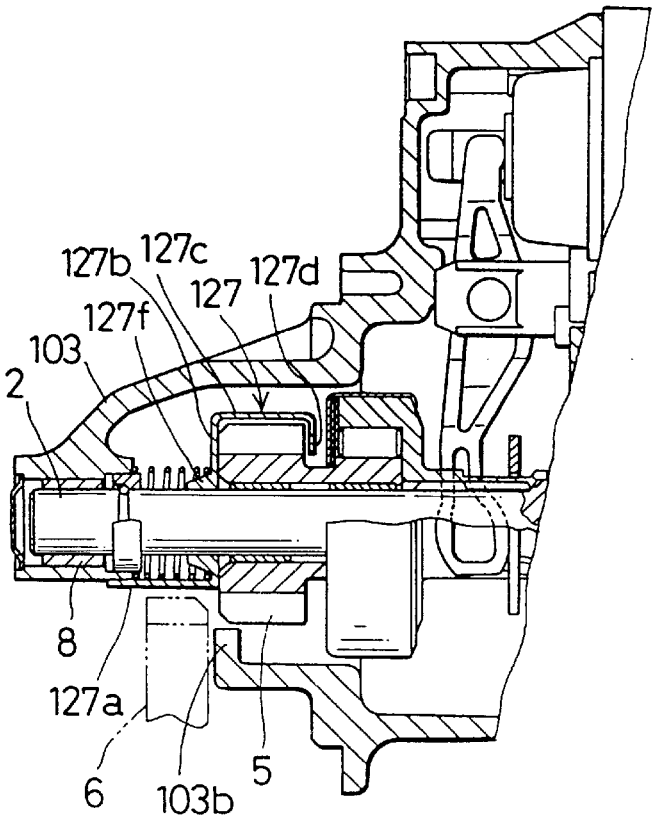
FIG. 9 is a part-sectional view of a portion of a starter that is not in operation, according to a third embodiment of the present invention.
Figure 10:
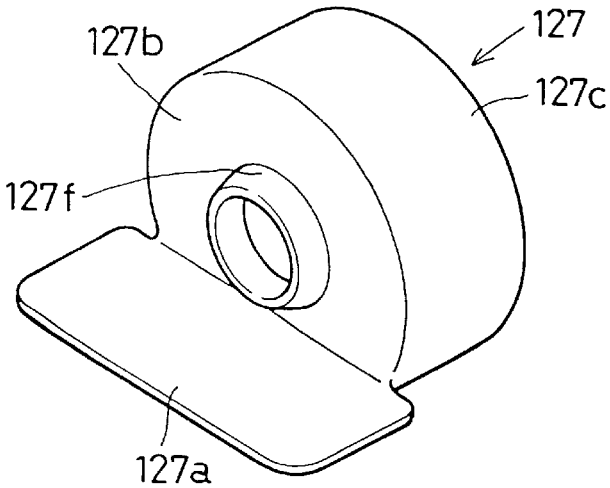
FIG. 10 is a perspective view of a cover according to the third embodiment of the present invention.

A third embodiment of the present invention is shown in FIGS. 9 and 10. Cover 127 has shutter portion 127*a*, front wall 127*b*, side wall 127*c*, rear wall 127*d* and pipe portion 127*f*. Pipe portion 127*f* has a protruded tapered shape and is slidable along output shaft 2.

Housing 103 has water barrier portion 103*b*. The gap between pinion gear 5 and barrier portion 103*b* is set as small as possible.

According to the third embodiment of the present invention, pipe portion 127*f* maintains the front wall 127*b* of cover 127 generally perpendicular to the axis of output shaft 2 so that cover 127 slides smoothly. Therefore, the structure of starter can be simplified. Furthermore, when the pinion moves to the engaged position (toward ring gear 6), mud and dust on output shaft 2 can be eliminated by the tapered portion of pipe portion 127*f*.

Fourth Embodiment

Figure 11:
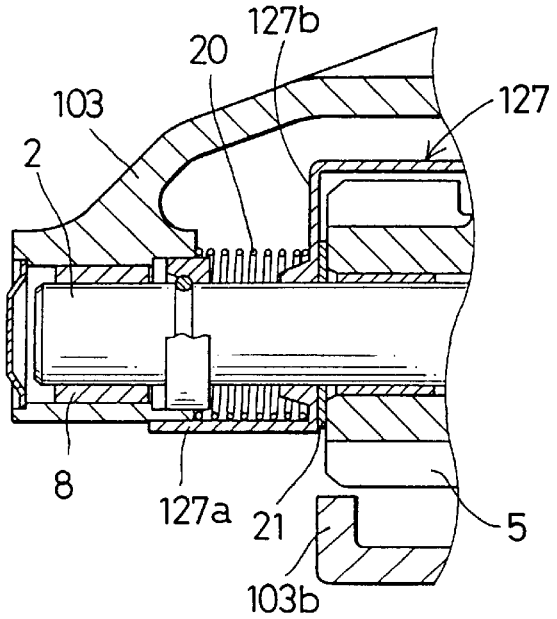
FIG. 11 is a part-sectional view of a portion of a starter that is not in operation, according to a fourth embodiment of the present invention.

A fourth embodiment of the present invention is shown in FIG. 11. The difference between the third embodiment and the fourth embodiment is washer 21.

Washer 21 is provided at between front wall 127*b* and pinion gear 5 and is fitted to output shaft 2 with a small gap to avoid rotating itself, even if pinion gear 5 rotates. According to the fourth embodiment, cover 127 can be prevented from rotating even if pinion gear 5 rotates because washer 21 does not rotate with pinion gear 5.

Fifth Embodiment

Figure 12:
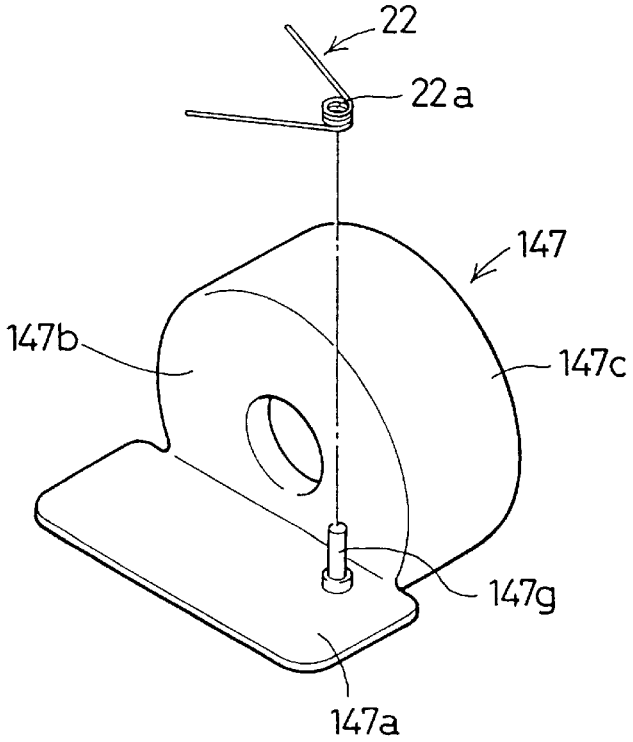
FIG. 12 is a perspective illustration of a cover and a coil spring according to a fifth embodiment of the present invention.

A fifth embodiment of the present invention is shown in FIG. 12. The differences between the second embodiment and the fifth embodiment are the structures of spring 22 and cover 147.

In the fifth embodiment, coil spring 22 is used to return cover 147 to the disengage position instead of spring 20, as in the second embodiment. Cover 147 has shutter portion 147*a*, front wall 147*b*, side wall 147*c* and pin 147*g* which is formed on shutter portion 147*a*. Coil portion 22*a* of coil spring 22 is fitted to pin 147*g*. One end of coil spring 22 contacts and pushes front wall 147*b* and the other end of coil spring 22 contacts and pushes housing 103. Cover 147 and the pinion are returned to the disengaged position by coil spring 22 as described in the second embodiment.

It is possible, in the alternative, to set the strength of coil spring 22 so that coil spring 22 returns only cover 147 and the pinion is returned by the return spring of magnetic switch 11.

Sixth Embodiment

Figure 13:
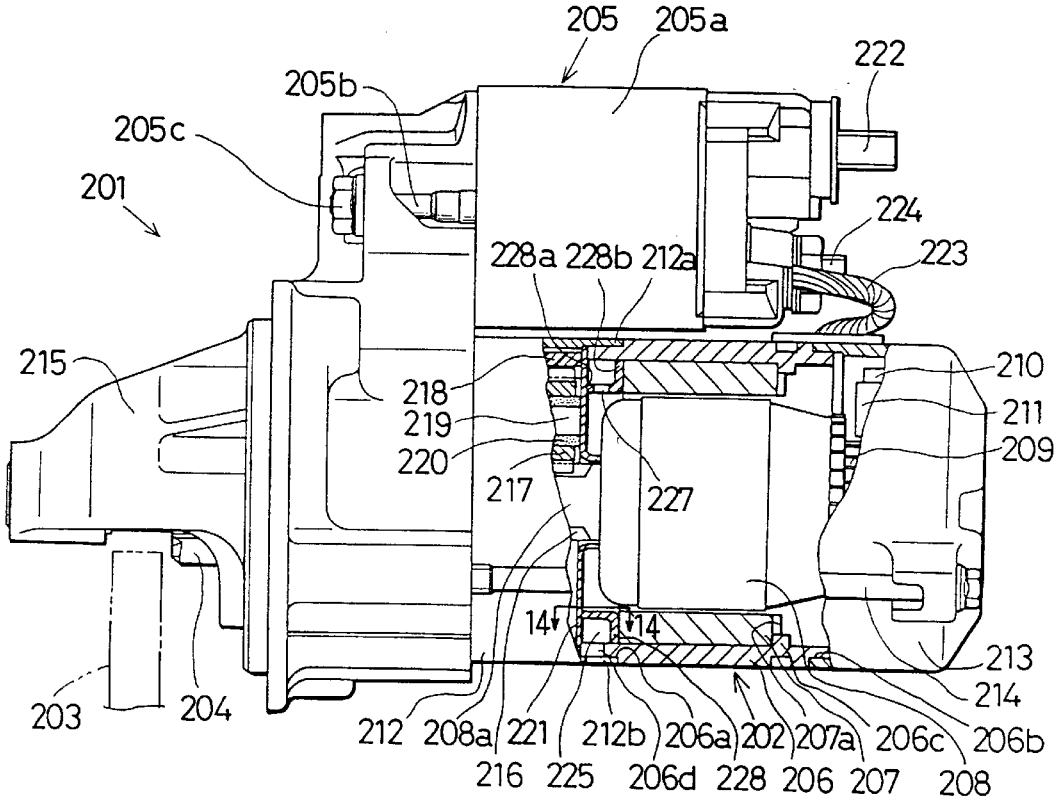
FIG. 13 is a part-sectional view of a starter according to a sixth embodiment of the present invention.
Figure 14:
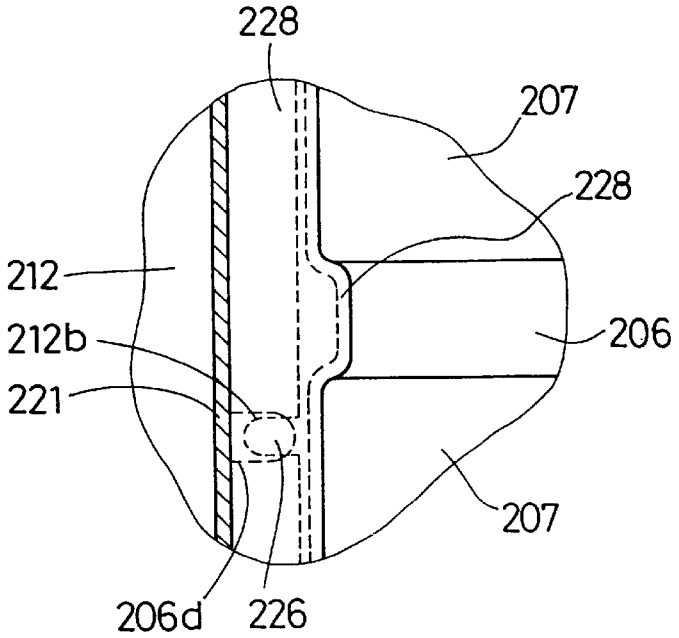
FIG. 14 is an enlarged view taken along line 14—14 of FIG. 13 of an outer ventilation hole in accordance with the sixth embodiment of the present invention.

A sixth embodiment of the present invention is shown in FIGS. 13 and 14. As shown in FIG. 13, starter 201 includes starter motor 202, epicyclic gear mechanism (described hereinafter), output shaft (not shown), pinion gear 204, magnetic switch 205 and ventilation mechanism (described hereinafter). The epicyclic mechanism reduces the rotational speed relative to starter motor 202 and transmits the rotational force to the output shaft. The ventilation mechanism ventilates between inner part and outer part of starter 201.

Starter motor 202 comprises yoke 206 which is a part of a field apparatus, permanent magnets 207 which are fixed inside of yoke 206, armature 208 which is rotated by a magnetic field, commutator 209 provided at the end of armature 208, brush 210 which contacts the outer periphery of commutator 209, and brush holding member 211 which holds brush 210.

Yoke 206 has a cylindrical shape and one of opening ends has spigot 206*a* and the other opening end has spigot 206*b*.

Spigot 206*a* is fitted in spigot 212*a* of center case 212. Spigot 206*b* is fitted in end frame 213. Center case 212, yoke 206 and end frame 213 are connected to housing 215 via through bolt 214.

A plurality of permanent magnets 207 are fixed along the circumferential direction of yoke 206 keeping the same distance between them. Each permanent magnet 207 has fixation groove 207*a*. Fixation groove 207*a* is fitted in protrusion 206*c*, which partly protrudes inside of yoke 206, made by pressing yoke 206 so that permanent magnet 207 is positioned in both radial and axial directions.

Rotation shaft 208*a* of armature 208 is rotatably supported at both ends by housing bearings (not shown) which are fitted in center case 212 and end frame 213. When a starter switch (not shown) is turned on, electricity is supplied to armature 208 because a motor contact (not shown) provided in magnetic switch 205 is turned on.

Epicyclic gear mechanism includes sun gear 216 formed on the periphery of rotation shaft 208*a*, multiple planetary gears 217 which are engaged with sun gear 216, and internal gear 218 which is engaged with each of the planetary gears 217. The revolutional force of each of the planetary gears 217 is transmitted to the output shaft via pin 219. Pin 219 rotatably supports planetary gear 217 via housing bearing 220. The epicyclic gear mechanism (speed reduction mechanism) is provided inside of center case 212 and is separated from yoke 206 by partition wall 221. Partition wall 221 is held between the edge of spigot 206*a* of yoke 206 and the notch of spigot 212*a* of center case 212.

The output shaft is rotatably supported by housing 215 and center case 212 via housing bearings (not shown) at its edges and is connected to the epicyclic gear mechanism via a one-way clutch (not shown in FIG. 13). The one-way clutch connects the epicyclic gear mechanism and the output shaft when the rotational force of starter motor 202 is transmitted to the output shaft and disconnects the epicyclic gear mechanism and the output shaft when pinion gear 204 and ring gear 203 are rotated together at high speed by the engine to prevent the rotation of pinion gear 204 from armature 208 of starter motor 202.

Pinion gear 204 is fitted to the outer periphery of the output shaft via helical spline (not shown in FIG. 13) and engages with ring gear 203 of the engine by being pushed forward (to the left in FIG. 13) along the helical spline on the output shaft.

Magnetic switch 205 generates magnetic field when a coil (not shown) in mgnetic switch 205 is electrified, and sucks a plunger (not shown in FIG. 13) provided in magnetic switch 205 and turns the motor contact on. Such suction power of the plunger pushes pinion gear 204 via pinion drive mechanism (not shown). Magnetic switch 205 is connected to the edge of housing 215 by bolt 205*b* and nut 205*c* formed on casing 205*a* of magnetic switch 205. Magnetic switch 205 has terminal 222 which is connected to the battery, and motor terminal 224 which is connected to motor lead wire 223 for starter motor 202. When magnetic switch 205 is operated (the plunger is sucked), terminals 222 and 224 are electrically connected.

The ventilation mechanism includes ventilation passage 225 which is formed as a ring shape along the inner periphery of yoke 206, outer ventilation hole 226 which connects ventilation passage 225 and the outside of starter 201, and inner ventilation hole 227 which connects ventilation passage 225 and the inside of starter 201.

Ventilation passage 225 is formed by yoke 206, partition wall 221 and ventilation ring 228. Ventilation ring 228, which is one example of a passage wall portion in accordance with the present invention, is made of nonmagnetic material and is provided between permanent magnet 207 and partition wall 221 at the inside periphery of yoke 206.

Ventilation ring 228, which has an L-shaped cross section, includes pipe portion 228*a* along the axial direction of rotation shaft 208*a* and protrusion portion 228*b* which protrudes in the radial direction of rotation shaft 208*a*. The end of pipe portion 228*a* contacts partition wall 221 about its entire periphery. The end of protrusion portion 228*b* contacts the inner periphery of yoke 206 about its entire periphery. The inner periphery of pipe portion 228*a* and the inner periphery of permanent magnet 207 are approximately the same distance from the center of rotation shaft 208*a*.

As shown in FIG. 14, ventilation ring 228 has bulge portion 228*c* on a part of protrusion portion 228*b* to hold permanent magnet 207. Bulge portions 228*c* are provided among each permanent magnet 207 to keep the distance along the peripheral direction between each permanent magnet 207 equal.

As shown in FIGS. 13 and 14, outer ventilation hole 226 is formed by notch 206*d* and notch 212*b*. Notch 206*d* is formed on spigot 206*a* of yoke 206. Notch 212*b* is formed on spigot 212*a* of center case 212. Notches 206*d* and 212*b* are formed to overlap each other to form outer ventilation hole 226. When starter 201 is mounted to a car, outer ventilation hole 226 is positioned at a lower part of starter 201 (closest to the ground). Ventilation passage 225 and the outside of starter 201 (outside of yoke 206 and center case 212) are interconnected through outer ventilation hole 226.

Ventilation passage 225 and the inside of starter motor 202 are interconnected through inner ventilation hole 227 which is formed on pipe portion 228*a* of ventilation ring 228. When starter 201 is mounted to a car, inner ventilation hole 227 is positioned at a higher part of starter 201 (approximately opposite to outer ventilation hole 226).

When there is a temperature difference between inside and outside of starter 201, caused by an increase in the internal temperature during operation of starter 201 or caused by an increase in the external temperature due to the heat of the engine, air can move between the inside and the outside of starter 201 through ventilation passage 225, outer ventilation hole 226 and inner ventilation hole 227.

When the car runs through a puddle or the like and water comes around outer ventilation hole 226, some of the water may enter ventilation passage 225 through outer ventilation hole 226. However, such water which enters ventilation passage 225 through outer ventilation hole 226 cannot reach inner ventilation hole 227 against the force of gravity because the water collides with the inside of the ring-shaped ventilation passage 225. Therefore, water can be prevented from entering starter motor 202 through inner ventilation hole 227.

According to the sixth embodiment, ventilation passage 225 can provide a long enough passage length to block water because ventilation passage 225 is formed along the inner periphery of yoke 206 in the gap between partition wall 221 and permanent magnet 207. Therefore, there is no part which protrudes outside starter 201 to protect it from water, and it is easy to install starter 201 to the engine. Furthermore, a reliable starter 201, which can prevent water from entering the starter motor 202, can be obtained. In this embodiment, permanent magnets 207 are used to generate a magnetic field, and they are supported by ventilation ring 228. However, coils that electrically generate a magnetic field can also be used in the same manner in lieu of permanent magnet 207.

Seventh Embodiment

Figure 15:
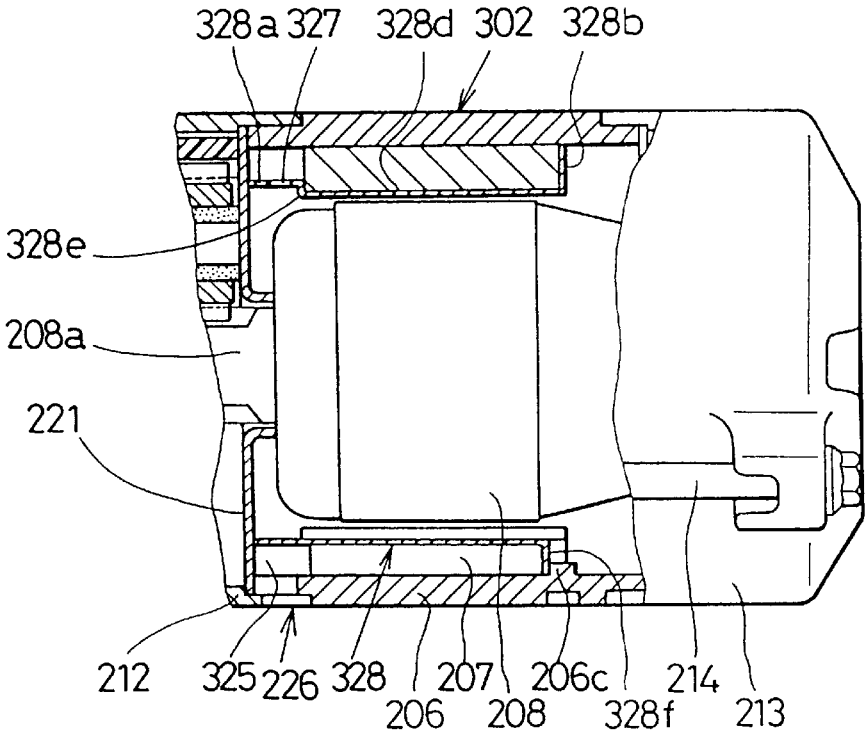
FIG. 15 is a part-sectional view of a portion of a starter according to a seventh embodiment of the present invention.
Figure 16:
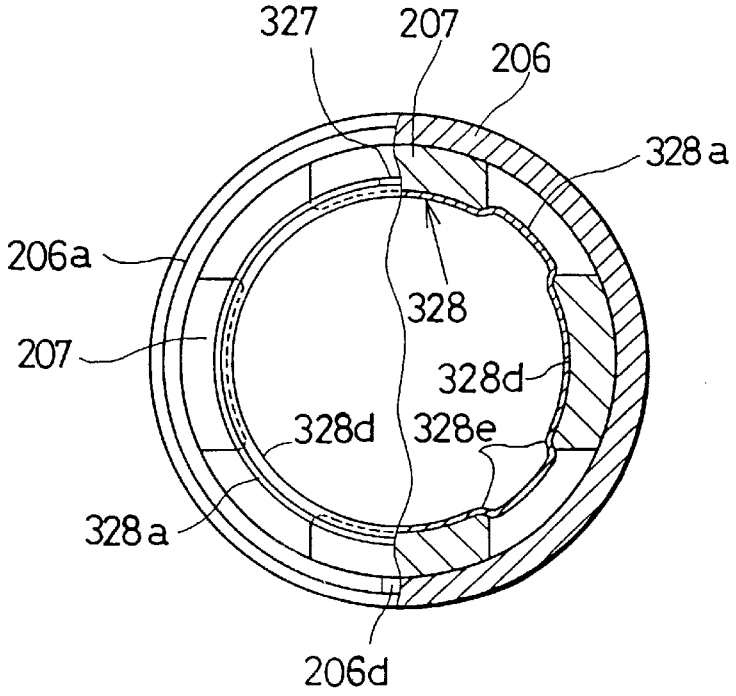
FIG. 16 is a part-sectional view of a field apparatus according to the seventh embodiment of the present invention.

A seventh embodiment of the present invention is shown in FIGS. 15 and 16. In the seventh embodiment, ventilation ring 328 is used for holding permanent magnet 207 instead of ventilation ring 228 as provided in the sixth embodiment.

Ventilation ring 328 has pipe portion 328*a,* for forming ventilation passage 325, which has a shape of extended pipe portion 228*a* of ventilation ring 228 in the sixth embodiment. Ventilation ring 328 has recess portion 328*d,* which protrudes toward the inside (the center of armature 208), on a part of pipe portion 328*a*. Recess portion 328*d* fits the inside of permanent magnet 207. Permanent magnet 207 is sandwiched between yoke 206 and recess portion 328*d*. Ventilation ring 328 also has protrusion portion 328*b* and step 328*e*. Step 328*e* is formed between pipe portion 328*a* and recess portion 328*d* in axial and radial directions. Permanent magnets 207 are held by steps 328*e* and protrusion portion 328*b*. Protrusion 328*b* has recess portion 328*f* which protrudes toward partition wall 221 between neighboring permanent magnets 207. Ventilation ring 328 and permanent magnet 207 are held by yoke 206 by fitting recess portion 328*f* to protrusion 206*c,* which protrudes toward the inside of yoke 206 and is made by pressing yoke 206.

According to seventh embodiment, the volume of ventilation passage 325 which is formed by ventilation ring 328, inner periphery of yoke 206 and partition wall 221 increases by the space formed between neighboring permanent magnets 207 comparing to the volume of ventilation passage 225 in the sixth embodiment. This increase of the volume may improve the prevention of water because the larger volume of ventilation passage 325 functions as an air damper and improves the water speed reducing effect (In other words, it becomes harder for water which enters into ventilation passage 225 through outer ventilation hole 226 to reach inner ventilation hole 327.).

Eighth Embodiment

Figure 17:
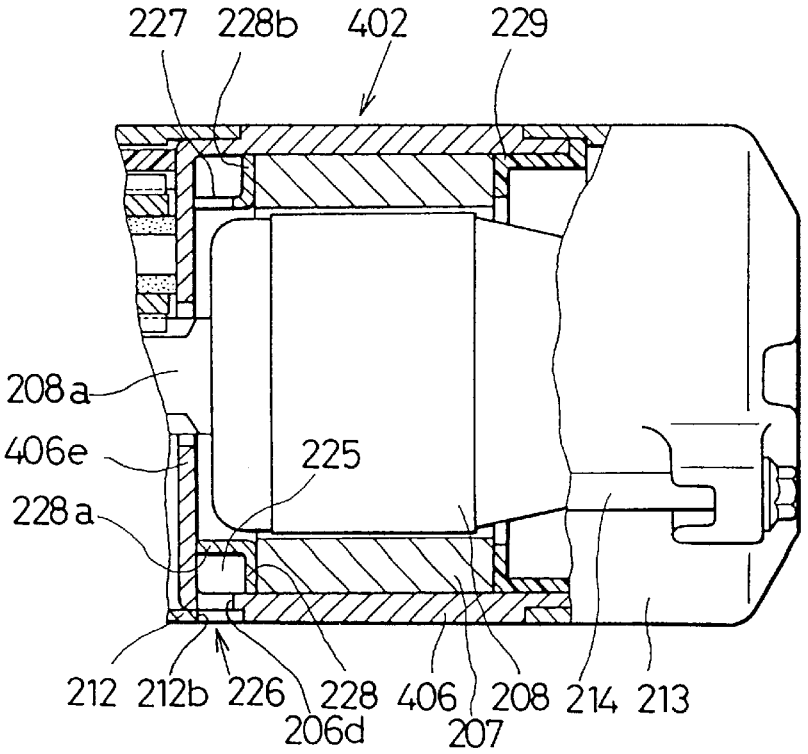
FIG. 17 is a part-sectional view of a portion of a starter according to an eighth embodiment of the present invention.

An eighth embodiment of the present invention is shown in FIG. 17. In the eighth embodiment, deep drawing yoke 406 which has bottom portion 406*e* is used instead of yoke 206 and partition wall 221 provided in the sixth and seventh embodiments. The structure and assembled state are the same as shown in the sixth embodiment. Bottom portion 406*e* corresponds to partition wall 221 in the sixth and seventh embodiments.

Magnet holder 229 is sandwiched and held between yoke 406 and end frame 213. Permanent magnet 207 is held in its axial direction by magnet holder 229.

When deep drawing yoke 406 is used, a spacer between bottom portion 406*e* and permanent magnet 207 or space between bottom portion 406*e* and permanent magnet 207 provided by a magnet stopper on yoke 406 made by pressing yoke 406 to prevent a leak of magnetic flux is required. However, according to the eighth embodiment, such spacer or magnet stopper can be omitted because ventilation ring 228 to form ventilation passage 225 also functions as such spacer between bottom portion 406*e* and permanent magnet 207.

Ninth Embodiment

Figure 18:
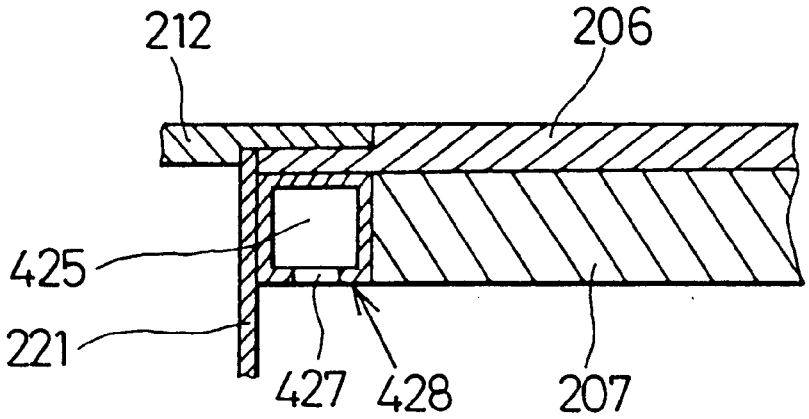
FIG. 18 is an enlarged sectional view of a portion of a ventilation ring and an inner ventilation hole according to a ninth embodiment of the present invention.
Figure 19:
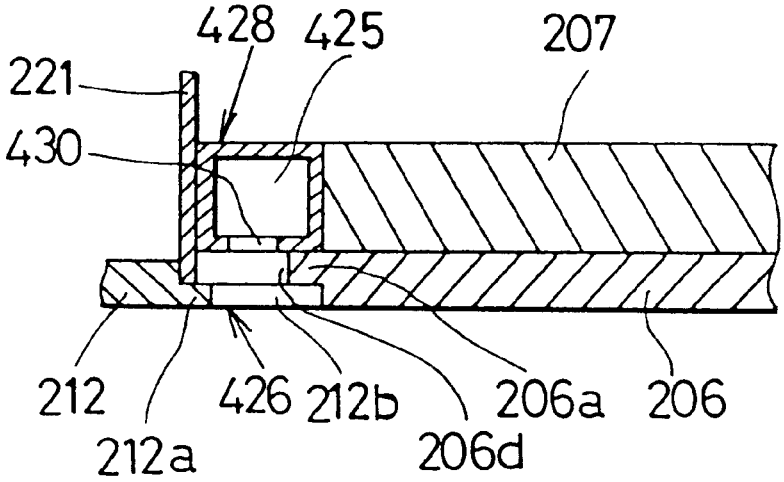
FIG. 19 is an enlarged sectional view of a portion of the ventilation ring and an outer ventilation hole in the ninth embodiment of the present invention.

A ninth embodiment of the present invention is shown in FIGS. 18 and 19. In the ninth embodiment, ventilation ring 428, whose cross section is a square ring, is used for forming ventilation passage 425.

Outer ventilation hole 426 is formed by notch 206*d* and notch 212*b*. Notch 206*d* is formed on spigot 206*a* of yoke 206. Notch 212*b* is formed on spigot 212*a* of center case 212. Notches 206*d* and 212*b* and opening hole 430 on the outer wall of ventilation ring 428 are formed to overlap each other to form outer ventilation hole 426. When the starter is mounted to a car, outer ventilation hole 426 is positioned at a lower part of the starter (closest to the ground). Ventilation passage 225 and the outside of the starter (outside of yoke 206 and center case 212) are interconnected through outer ventilation hole 426.

Ventilation passage 425 and the inside of the starter motor are interconnected through inner ventilation hole 427 which is formed on the inner wall of ventilation ring 428. When the starter is mounted to a car, inner ventilation hole 427 is positioned at a higher part of the starter (approximately opposite to outer ventilation hole 426).

According to the ninth embodiment, the same advantage as shown in the sixth embodiment may be obtained because ring-shaped ventilation passage 425 is formed inside of yoke 206 the same as the sixth embodiment.

Although permanent magnets 207 are positioned by protrusion 206*c* which is made by pressing yoke 206 in the sixth and seventh embodiments, permanent magnets 207 may instead be attached by adhesive using a jig for positioning permanent magnets 207. In this case, it may be possible to use protrusion 206*c* to guide the jig.

Instead of using magnet holder 229 in the eighth embodiment, it may be possible to use the adhesive and the jig described above for assembling permanent magnet 207 or to provide a protrusion, which corresponds to protrusion 206*c* in the sixth and seventh embodiments, on yoke 406. .

In the sixth and seventh embodiments, ventilation passage 225, 325 is formed by yoke 206, partition wall 221 and ventilation ring 228, 328. However, instead of using partition wall 221 and ventilation ring 228, 328, it may be possible to use a ventilation ring which is made integral with a part of or whole of partition wall 221.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A starter for an engine, comprising:

a housing;

a starter motor being provided in said housing and having a field apparatus including a tubular yoke, said yoke being provided to form a part of said housing;

an annular ventilation passage being defined along an inner periphery of said yoke;

a first ventilation hole being defined proximate a bottom portion of said housing for interconnecting an inside of said ventilation passage to an outside of said housing; and a second ventilation hole being defined proximate a top portion of said ventilation passage for interconnecting said inside of said ventilation passage to an inside of said starter motor, wherein:

said ventilation passage further includes a partition wall and a passage wall portion;

said partition wall protrudes from said yoke toward said inside of said yoke for dividing said housing;

said passage wall portion forms said ventilation passage together with a part of said partition wall and a part of said inner periphery of said yoke; and said second ventilation hole is defined proximate a top portion of said passage wall portion.

2. A starter according to claim 1, wherein:

said field apparatus further includes a permanent magnet;

said passage wall portion is made of a nonmagnetic material; and said passage wall portion is disposed between said partition wall and said permanent magnet.

3. A starter according to claim 2, wherein said passage wall portion restricts at least one of an axial and a radial movement of said permanent magnet.

4. A starter according to claim 2, wherein said partition wall is integrally provided with said yoke.

5. A starter according to claim 1, wherein said passage wall portion restricts at least one of an axial and a radial movement of said permanent magnet.

6. A starter according to claim 1, wherein said partition wall is integrally provided with said yoke.

7. A starter according to claim 1, wherein:

said field apparatus further includes a permanent magnet;

said passage wall portion is made of a nonmagnetic material; and said passage wall portion is disposed adjacent to one end of said permanent magnet.

8. A starter according to claim 7, wherein said passage wall portion restricts at least one of an axial and a radial movement of said permanent magnet.

9. A starter according to claim 7, wherein said partition wall is integrally provided with said yoke.

10. A starter for an engine, comprising:

a housing;

a starter motor being provided in said housing and having a field apparatus including a tubular yoke, said yoke being provided to form a part of said housing;

an annular ventilation passage being defined along an inner periphery of said yoke;

a first ventilation hole being defined proximate a bottom portion of said housing for interconnecting an inside of said ventilation passage to an outside of said housing; and a second ventilation hole being defined proximate a top portion of said ventilation passage for interconnecting said inside of said ventilation passage to an inside of said starter motor, wherein a passage wall portion defining said ventilation passage restricts at least one of an axial and a radial movement of said field apparatus.

11. A starter according to claim 10, wherein said ventilation passage is integrally provided with said yoke.

* * * * *